US008126153B2

(12) United States Patent
Fischer

(10) Patent No.: US 8,126,153 B2
(45) Date of Patent: Feb. 28, 2012

(54) HEARING SYSTEM WITH PARTIAL BAND SIGNAL EXCHANGE AND CORRESPONDING METHOD

(75) Inventor: Eghart Fischer, Schwabach (DE)

(73) Assignee: Siemens Medical Instruments Pte. Ltd., Singapore (SG)

( * ) Notice: Subject to any disclaimer, the term of this patent is extended or adjusted under 35 U.S.C. 154(b) by 408 days.

(21) Appl. No.: 12/383,036

(22) Filed: Mar. 19, 2009

(65) Prior Publication Data

US 2009/0238385 A1 Sep. 24, 2009

(30) Foreign Application Priority Data

Mar. 20, 2008 (DE) ..... 10 2008 015 263

(51) Int. Cl.
*H04R 25/00* (2006.01)

(52) U.S. Cl. ..... 381/23.1; 381/60; 381/312; 381/320; 600/25; 607/55; 607/57

(58) Field of Classification Search ..... 381/23.1, 381/320, 60, 312; 600/25; 607/55, 57
See application file for complete search history.

(56) References Cited

U.S. PATENT DOCUMENTS

2004/0037442 A1* 2/2004 Nielsen et al. ..... 381/315
2006/0198529 A1* 9/2006 Kjems et al. ..... 381/26

FOREIGN PATENT DOCUMENTS

EP 1771038 A2 4/2007
WO WO 9943185 A1 8/1999
WO WO 2004114722 A1 12/2004

* cited by examiner

*Primary Examiner* — Jerome Jackson, Jr.
*Assistant Examiner* — Yu Chen

(57) ABSTRACT

A binaural supply with a hearing system is to be enabled, whereby the computing outlay and energy consumption are to be kept as minimal as possible. A hearing system comprising a first hearing apparatus including a first signal input facility and a first communication facility and a second hearing apparatus including a second signal input facility, a second communication facility for receiving a signal from the first communication facility and a second signal processing facility for processing signals from the second signal input facility and the second communication facility are provided to form a common output signal. The signal transmitted from the first to the second communication facility corresponds to a real spectral part of the overall frequency spectrum of the first input signal. As only one part of the overall spectrum is transmitted and/or binaurally processed, the computing outlay and energy consumption is reduced.

10 Claims, 2 Drawing Sheets

HEARING SYSTEM WITH PARTIAL BAND SIGNAL EXCHANGE AND CORRESPONDING METHOD

CROSS REFERENCE TO RELATED APPLICATIONS

This application claims priority of German application No. 10 2008 015 263.3 filed Mar. 20, 2008, which is incorporated by reference herein in its entirety.

FIELD OF THE INVENTION

The present invention relates to a hearing system for the binaural supply of a user with a first hearing apparatus and a second hearing apparatus. Furthermore, the present invention relates to a method for processing signals for a binaural supply with a first and a second hearing apparatus. The term "hearing apparatus" is understood here to mean any sound-emitting device which can be worn on or in the ear, like for instance a hearing device, a headset, earphones and suchlike.

BACKGROUND OF THE INVENTION

Hearing devices are wearable hearing apparatuses which are used to assist the hard-of-hearing. In order to accommodate numerous individual requirements, various types of hearing devices are available such as behind-the-ear (BTE) hearing devices, hearing device with external receiver (RIC: receiver in the canal) and in-the-ear (ITE) hearing devices, for example also concha hearing devices or completely-in-the-canal (ITE, CIC) hearing devices. The hearing devices listed as examples are worn on the outer ear or in the auditory canal. Bone conduction hearing aids, implantable or vibrotactile hearing aids are also available on the market. The damaged hearing is thus stimulated either mechanically or electrically.

The key components of hearing devices are principally an input converter, an amplifier and an output converter. The input converter is normally a receiving transducer e.g. a microphone and/or an electromagnetic receiver, e.g. an induction coil. The output converter is most frequently realized as an electroacoustic converter e.g. a miniature loudspeaker, or as an electromechanical converter e.g. a bone conduction hearing aid. The amplifier is usually integrated into a signal processing unit. This basic configuration is illustrated in FIG. 1 using the example of a behind-the-ear hearing device. One or a plurality of microphones 2 for recording ambient sound are built into a hearing device housing 1 to be worn behind the ear. A signal processing unit 3 which is also integrated into the hearing device housing 1 processes and amplifies the microphone signals. The output signal for the signal processing unit 3 is transmitted to a loudspeaker or receiver 4, which outputs an acoustic signal. Sound is transmitted through a sound tube, which is affixed in the auditory canal by means of an otoplastic, to the device wearer's eardrum. Power for the hearing device and in particular for the signal processing unit 3 is supplied by means of a battery 5 which is also integrated in the hearing device housing 1.

A hearing device system for the binaural supply of a person who is hard of hearing includes two hearing devices, one of which is worn on the left ear and the other on the right ear. If the two hearing devices communicate with one another in any fashion (e.g. by way of a wireless connection), this is referred to as a "binaurally coupled hearing system". A binaurally coupled hearing system of this type has the possibilities of spatial signal processing, which is not possible using a monaural system, since with this system signals can be transmitted from one side to the other.

Approaches to binaural beam forming algorithms (beam forming) or blind separation algorithms (blind source separation) are known from the literature for instance. The element common to these known algorithms is that the necessary transmission capacity of the connection between the two devices has to be comparatively high since in order to calculate the output signal on the one side, both the overall input signal of the same side and also that of the other side are needed. A correspondingly high data transmission rate is thus needed for broadband communication, which is disadvantageous in respect of the high energy consumption associated therewith in the case of hearing devices. Only monaural methods are known as alternatives, which however are restricted as a result of the very minimal microphone distances above all in the case of low frequencies. Methods for realizing a directional microphone, a blind source separation, a feedback coupling reduction etc. are affected for instance.

Monaural methods of this type comprising one, two or more microphones per side indicate very good properties in respect of their performances such as interference noise suppression and noise performance in the case of higher frequencies (>2 kHz). In the case of low frequencies, the noise problems occurring as a matter of principle (as a result of the inherent noise always present in the microphones in conjunction with the minimal microphone distance) nevertheless cannot continue.

The publication WO 99/431185 A1 discloses a binaural, digital hearing aid system, in which data is transmitted crosswise from the right to left and from the left to right hearing device. The data received by the other hearing device in each instance is processed binaurally using the actual data of the hearing device. If necessary, data is compressed prior to transmission.

The publication EP 1 771 038 A2 also discloses a method for operating a hearing aid device system for the binaural supply of a user. In frequency ranges, in which problematic feedback is to be expected, the input signals are transmitted crosswise to the other hearing device in each instance, so that an acoustic signal received by the microphone of a hearing aid device can be output via the receiver of the other hearing aid device in each instance following signal processing and amplification. As a result, the distance between a receiver and a microphone in each instance, between which a feedback path exists, is significantly increased for the relevant audio signals.

The publication WO 2004/114722 A1 also discloses a binaural hearing aid system with a coordinated sound processing. Here data relating to the classification of the sound environment is exchanged between both hearing devices.

SUMMARY OF THE INVENTION

The object of the present invention thus consists in providing a hearing system for the binaural supply of a user, in which data can be transmitted between two hearing apparatuses, in which the energy and/or computing outlay for the data exchange and/or the processing of the exchanged data is as minimal as possible however. Furthermore, a corresponding method for processing signals is to be provided.

This object is achieved in accordance with the invention by a hearing system for the binaural supply of a user with a first hearing apparatus including a first signal input facility for supplying a first input signal and a first communication facility, as well as a second hearing apparatus including a second signal input facility for supplying a second input signal, a second communication facility for receiving a signal from the first communication facility and a second signal processing facility for processing signals from the second signal input facility and the second communication facility to form a common output signal, with the signal transmitted from the first to the second communication facility corresponding to a real spectral part of the overall frequency spectrum of the first input signal, and with the transmitted part being binaurally processed in the spectral part of the overall frequency spectrum together with a signal from the second signal processing facility, while the signal from the second signal processing facility is monaurally processed by the second signal processing facility in the remaining part of the overall frequency spectrum.

Furthermore, provision is made in accordance with the invention for a method for processing signals for a binaural supply with a first and a second hearing apparatus by providing a first input signal in the first hearing apparatus, providing a second input signal in the second hearing apparatus, transmitting a signal from the first to the second hearing apparatus, processing the second input signal together with the signal from the first hearing apparatus in the second hearing apparatus to form an output signal of the second hearing apparatus, with the signal transmitted from the first to the second hearing apparatus corresponding to a real spectral part of the overall frequency spectrum of the first input signal, and with the transmitted signal being binaurally processed in the spectral part of the overall frequency spectrum together with a corresponding spectral part of the second input signal of the second hearing apparatus by the second hearing apparatus, while the second input signal of the second hearing apparatus is monaurally processed in the remaining part of the overall frequency spectrum by the second hearing apparatus.

Signals are advantageously prevented from being exchanged in full bandwidth between the two hearing apparatuses of a hearing system. Instead, only partial bands of the relevant signals are transmitted. As a result, the information flow and the computing outlay associated therewith is reduced to a minimum.

The first hearing apparatus preferably exhibits a first signal processing facility in order to process signals from the first signal input facility together with signals from the first communication facility, which originate from the second hearing apparatus, to form a common output signal. A mutual data exchange between the two hearing apparatuses is thus ensured. Even this intensive exchange of data may profit from a reduction in the transmission bandwidth.

The first and the second signal input facility may comprise at least two microphones in each instance. A beam forming or a high-quality directional microphone and/or a high-quality blind source separation can thus already be realized in the individual hearing apparatuses for instance. In order to then use the results for the spatial hearing, only the relevant spectral parts of these results are transferred to the other hearing apparatus in each instance.

It is particularly favorable for a low frequency part of the respective input signal to be exclusively transmitted during signal transmission between the two communication facilities. It is advantageous here for instance if the frequencies of the low frequency part lie below 1 kHz or 2 kHz. It is generally sufficient to exchange the low frequency parts in order to improve the binaural supply between the hearing apparatuses and/or hearing devices.

As was already indicated, a feedback coupling reduction algorithm, a beam forming algorithm or a blind source separation algorithm (blind source separation), which uses signals from the other hearing apparatus in each instance, can be implemented in the first and/or second signal processing facility. A significant saving in terms of computing outlay and energy consumption can thus be achieved particularly with these algorithms, in which the data exchange between the hearing apparatus brings significant advantages.

BRIEF DESCRIPTION OF THE DRAWINGS

The present invention is explained in more detail with reference to the appended drawings, in which.

DETAILED DESCRIPTION OF THE INVENTION

The exemplary embodiment shown in more detail below represents a preferred embodiment of the present invention.

Figure 1:
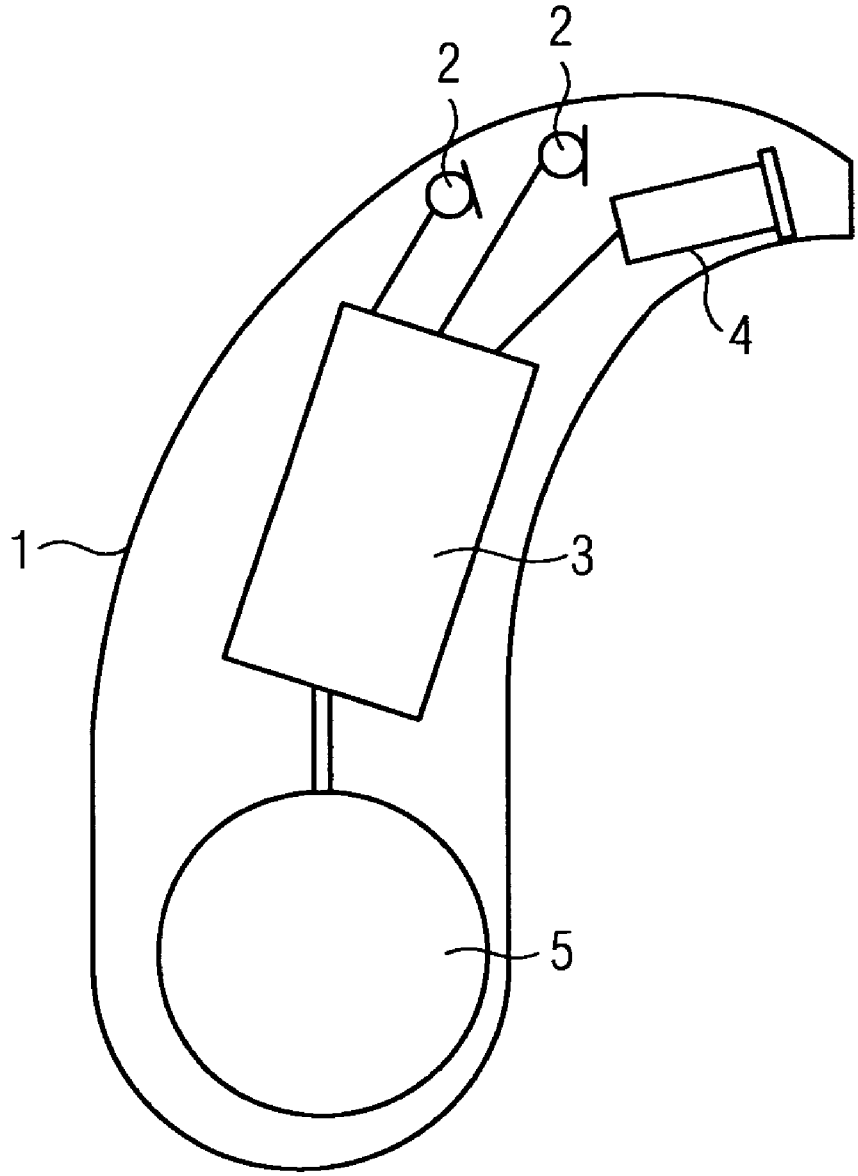
FIG 1 (Prior art)
FIG. 1 shows the main design of a hearing device according to the prior art and FIG. 2 shows a block diagram of an inventive hearing device system for the binaural supply.
Figure 2:
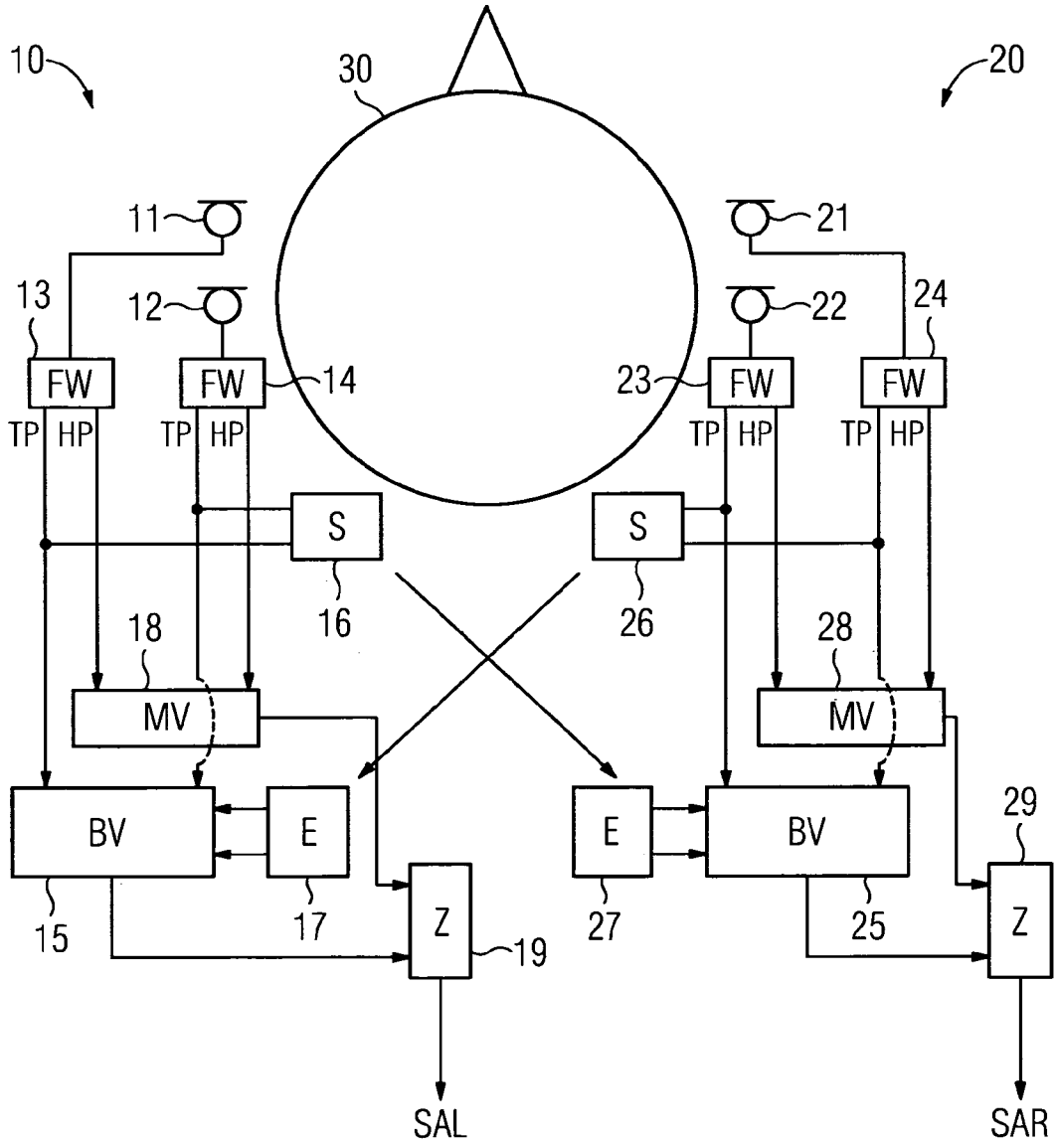

FIG. 2 shows a schematic representation of hearing device system with a left hearing device 10 and a right hearing device 20 for the binaural supply of a hearing device wearer 30. The left hearing device has two microphones 11 and 12 in order to realize a directional microphone or to execute beam forming, blind source separation and suchlike. The output signals of the microphones 11 and 12 are each fed to a cross-over network 13, 14. Each of these two cross-over networks 13 and 14 has a low pass filter output TP and a high pass filter output HP. Instead of or in addition to the microphones 11 and 12, other signal input facilities, like for instance a telephone coil, a radio antenna and suchlike can also be used for instance.

The low frequency parts of the input signals from the cross-over networks 13 and 14 are fed to a binaural processing unit 15. At the same time, the low frequency parts are fed to a transmitter 16 integrated into the hearing device in order to transmit them wirelessly to the right hearing device 20. Conversely, a receiver 17 receives the low frequency part from input signals from the right hearing device and makes them available for the binaural processing unit 15. The low frequency parts of the input signals of the left hearing device and of the right hearing device are binaurally processed together there and a low frequency output signal is generated.

The high-frequency parts of the cross-over networks 13 and 14 are fed to a monaural processing unit 18. This unit generates a high-frequency output signal and supplies it to an adder and/or combining unit 19. It links the high-frequency output signal of the monaural processing unit 18 to the low frequency output signal of the binaural processing unit 15 to form a common output signal SAL of the left hearing device 10. This output signal SAL is optionally processed and/or fed to a receiver (not shown).

The right hearing device 20 is designed in symmetry with the left hearing device 10 in respect of the signal flow of interest here. It likewise exhibits two microphones 21 and 22, the signals of which with cross-over networks 23 and 24 are split into high frequency and low frequency parts. The low frequency parts are processed on the one hand by a binaural processing unit 25 and are transmitted on the other hand from a transmitter 26 to the receiver 17 of the left hearing device. A receiver 27 receives the low frequency signals of the transmitter 16 from the left hearing device 10 and makes these available for the common processing with the low frequency parts of the right hearing device 20 in the binaural processing unit 25.

The high frequency parts of the input signal are fed from the cross-over networks 23 and 24 to a monaural processing unit 28. Like in the left hearing device 10, the low frequency output signal of the binaural processing unit 25 and the high frequency output signal of the monaural processing unit 28 are then also combined here in a combining unit 29 to form a common process signal SAR of the right hearing device.

The two hearing devices 10 and 20 thus each exhibit a communication facility, namely a transmitter and a receiver 16, 17 and/or 26, 27 for bidirectional communication. There is basically also the possibility of only one monodirectional communication with a transmitter on the one side and a receiver on the other side being used, if this is advantageous for the binaural supply. Accordingly, a signal processing facility (e.g. binaural supply unit 15 or 25) would then also only be necessary in a hearing device.

In respect of the function of the hearing device system shown in FIG. 2, it is relevant in accordance with the invention for the input signals to be split into two frequency ranges, e.g. a low frequency range below 1 to 2 kHz and a high frequency range above approximately 1 to 2 kHz. Only the low frequency parts are processed binaurally and transmitted to the other side in each instance, since the high frequency parts can also be processed exclusively monaurally to a satisfactory degree. Once the respective parts have been processed binaurally or monaurally, they are then combined to form two monaural output signals SAL and SAR.

The advantage of this division of the signal to be processed is that a lower data rate is necessary both for the processing as well as for the transmission than in the case of a broadband transmission and/or processing. In the tangible example, only the low frequency signals below approximately 1 to 2 kHz have to be transmitted.

A further advantage of the binaural processing system consists in hardly any problems occurring with microphone noise in the case of low frequencies. The reason for this is that the microphone signals in the low frequency range are exchanged between the left and the right hearing device and a larger microphone distance, namely the distance from head to the other side, thus exists. This is particularly important especially for differential directional microphones.

Another advantage of the presented system consists in even smaller microphone distances than previously being possible for monaural processing of the high frequencies, since only higher frequency parts can be processed monaurally. The individual hearing devices can thus be of a more compact design if necessary.

The invention claimed is:

1. A hearing system for a binaural supply to a user, comprising:

a first hearing apparatus comprising:

a first signal input unit, wherein the first signal input unit comprises at least two microphones coupled to supply respective first input signals;

a first communication unit coupled to receive a real spectral part of an overall frequency spectrum of the respective first input signals, wherein the real spectral part of the overall frequency spectrum of the respective first input signals comprises a low frequency part of each of the respective first input signals; and a second hearing apparatus comprising:

a second signal input unit coupled to supply a second input signal, a second communication unit coupled to receive the low frequency part of each of the respective first input signals from the first communication unit and the real spectral part of the overall frequency spectrum of the second input signal; and a second signal processing unit configured to:

binaurally process the real spectral part of the overall frequency spectrum of the respective first input signals together with the real spectral part of the overall frequency spectrum of the second input signal, monaurally process a remaining spectral part of the overall frequency spectral of the second input signal; and generate a second common output signal from the binaurally processed signals and the monaurally processed second input signal.

2. The hearing system as claimed in claim 1, wherein the first hearing apparatus comprises a first signal processing unit coupled to receive the real spectral part of the overall frequency spectrum of the second input signal.

3. The hearing system as claimed in claim 2, wherein the first signal processing unit is configured to:

binaurally processes the real spectral part of the overall frequency spectrum of the respective first input signals together with the real spectral part of the overall frequency spectrum of the second input signal, monaurally processes a remaining spectral part of the overall frequency spectral of the respective first input signals, and generates a first common output signal from the binaurally processed signals and the monaurally processed first input signals.

4. The hearing system as claimed in claim 2, wherein the first and the second signal processing units are respectively configured to process an algorithm selected from the group consisting of a feedback reduction algorithm, a beam forming algorithm, and a blind source separation algorithm.

5. The hearing system as claimed in claim 1, wherein the second signal input unit comprises at least two microphones coupled to supply respective second input signals.

6. The hearing system as claimed in claim 5, wherein the real spectral part of the overall frequency spectrum of the respective second input signals comprises a low frequency part of each of the respective second input signals wherein the second communication unit is configured to transmit the low frequency part of each of the respective second input signals to the first communication unit.

7. The hearing system as claimed in claim 6, wherein the low frequency part comprises a range up to about 1 kHz.

8. The hearing system as claimed in claim 6, wherein the low frequency part comprises a range up to about 2 kHz.

9. A method for processing signals from a hearing system comprising a first and a second hearing apparatus for a binaural supply to a user, comprising:

coupling at least two microphones to supply respective first input signals in the first hearing apparatus;

providing a second input signal in the second hearing apparatus;

transmitting a real spectral part of an overall frequency spectrum of the respective first input signals to the second hearing apparatus, wherein the transmitted real spectral part of the overall frequency spectrum of the respective first input signals comprises a low frequency part of each of the respective first input signals;

binaurally processing the real spectral part of the overall frequency spectrum of the respective first input signals together with the real spectral part of the overall frequency spectrum of the second input signal in the second hearing apparatus;

monaurally processing a remaining spectral part of the overall frequency spectral of the second input signal in the second hearing apparatus; and generating a second common output signal from the binaurally processed signals and the monaurally processed second input signal.

10. The method as claimed in claim 9, further comprising:

coupling at least two microphones to supply respective second input signals in the second hearing apparatus;

transmitting the real spectral part of the overall frequency spectrum of the respective second input signals to the first hearing apparatus, wherein the transmitted real spectral part of the overall frequency spectrum of the respective second input signals comprises a low frequency part of each of the respective second input signals;

binaurally processing the real spectral part of the overall frequency spectrum of the respective first input signals together with the real spectral part of the overall frequency spectrum of the respective second input signals in the first hearing apparatus;

monaurally processing a remaining spectral part of the overall frequency spectral of the respective first input signals in the first hearing apparatus; and generating a first common output signal from the binaurally processed signals and the monaurally processed first input signals.

* * * * *